US009345975B2

(12) United States Patent
Xu et al.

(10) Patent No.: US 9,345,975 B2
(45) Date of Patent: May 24, 2016

(54) SWINGING CHAIR

(71) Applicant: Plow & Hearth LLC, Madison, VA (US)

(72) Inventors: Ting Xu, Richmond, VA (US); Amanda Lacy, Charlottesville, VA (US)

(73) Assignee: Plow & Hearth, LLC, Madison, VA (US)

( * ) Notice: Subject to any disclaimer, the term of this patent is extended or adjusted under 35 U.S.C. 154(b) by 0 days.

(21) Appl. No.: 14/334,882

(22) Filed: Jul. 18, 2014

(65) Prior Publication Data

US 2015/0076888 A1 Mar. 19, 2015

Related U.S. Application Data

(60) Provisional application No. 61/845,182, filed on Jul. 11, 2013.

(51) Int. Cl.
*A63G 9/14* (2006.01)

(52) U.S. Cl.
CPC ..... *A63G 9/14* (2013.01)

(58) Field of Classification Search
CPC ..... A63G 9/14; A47C 7/14; A47C 1/00; A47C 3/00; A47C 3/16
USPC ..... 297/281, 274, 452.63, 452.56; 472/118; 5/120
See application file for complete search history.

(56) References Cited

U.S. PATENT DOCUMENTS

| | | | | |
|---|---|---|---|---|
| 1,057,360 | A * | 3/1913 | Patten | 297/274 |
| 3,913,978 | A * | 10/1975 | Lester | 297/448.2 |
| 4,289,310 | A * | 9/1981 | Weakly | 472/118 |
| 7,367,068 | B2 * | 5/2008 | Huff | 5/120 |
| D677,920 | S | 3/2013 | Christakos | |
| D681,970 | S | 5/2013 | Christakos | |
| D683,156 | S | 5/2013 | Christakos | |
| D688,057 | S | 8/2013 | Christakos | |
| D711,143 | S * | 8/2014 | Christakos et al. | D6/368 |
| 2012/0178543 | A1 * | 7/2012 | Monachello | 472/118 |

FOREIGN PATENT DOCUMENTS

| | | | |
|---|---|---|---|
| CN | 201930310 U | * | 8/2011 |
| GB | 000859674 A | * | 1/1961 |

* cited by examiner

*Primary Examiner* — Milton Nelson, Jr.
(74) *Attorney, Agent, or Firm* — Jordan IP Law, LLC; Todd A. Vaughn

(57) ABSTRACT

A swinging chair having a base seating portion composed of bungee cords and a suspension system that permits the base seating portion to hang or otherwise be suspended so it dually functions as a swing.

13 Claims, 10 Drawing Sheets

Bottom

Bottom

Top

Bottom

SWINGING CHAIR

CROSS-REFERENCE TO RELATED APPLICATIONS

The present application claims priority under 35 U.S.C. §119 to U.S. Provisional Patent Application No. 61/845,182 (filed on Jul. 11, 2013), which is hereby incorporated by reference in its entirety.

TECHNICAL FIELD

Embodiments relate to a swinging chair having a base seating portion composed of bungee cords and a suspension system that permits the base seating portion to hang or otherwise be suspended so it dually functions as a swing.

BACKGROUND

Bungee chairs have a seating area composed of bungee cords, and foldable legs upon which the seating area is supported on the ground surface.

DRAWINGS

DESCRIPTION

Figure 1:
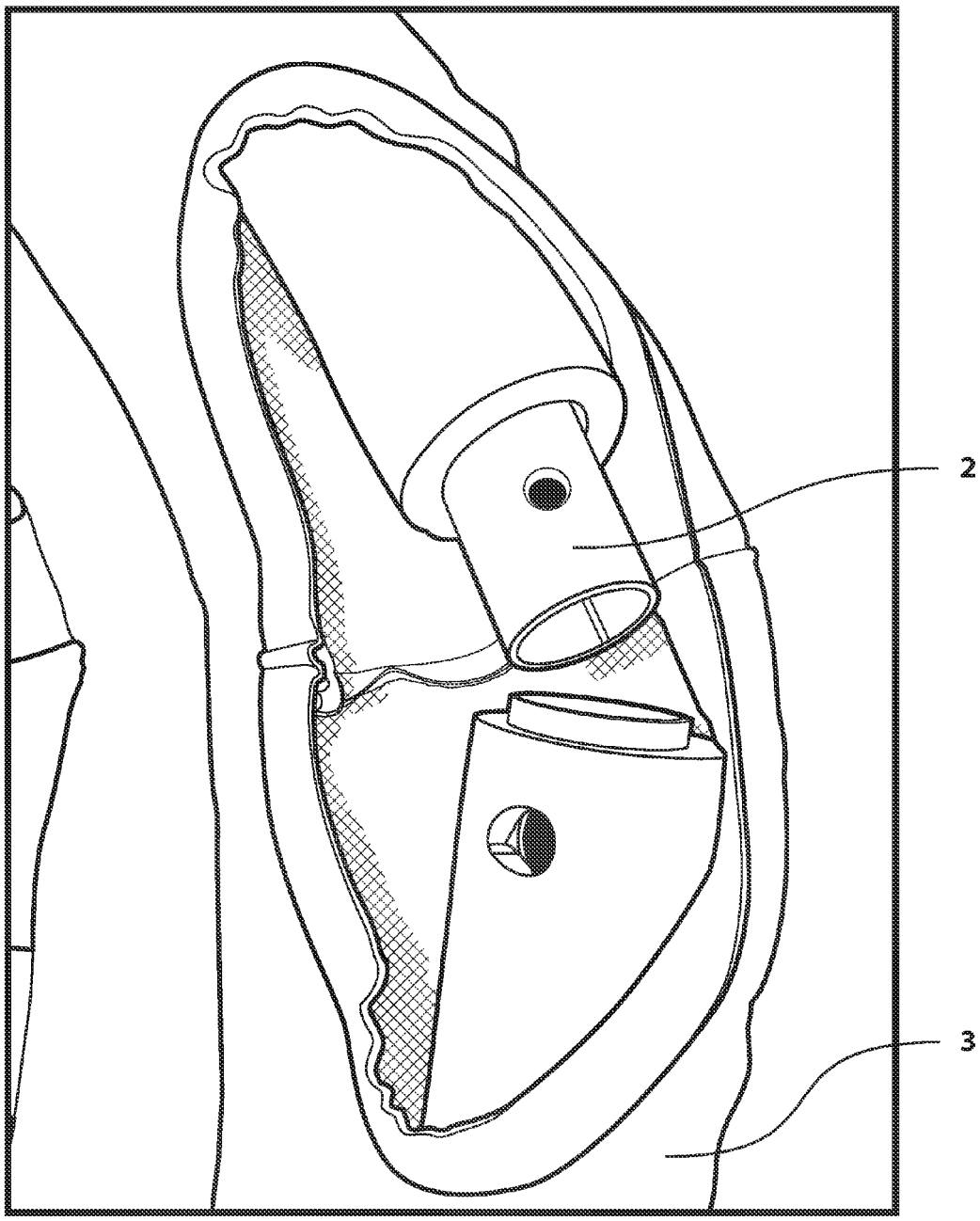
FIG. 1 illustrates a sectional view of a frame of a swinging chair in an unconnected state, in accordance with embodiments.

As illustrated in FIGS. 1 to 10, in accordance with embodiments, a chair is provided that may be suspended indoors or outdoors at a support point or at least one support point in order to serve both as a hanging chair and/or a swing. The chair may be used as a trampoline type swing, or serve as a bottom portion of a hanging tent or play structure, or be used to create tree top play spaces and rope courses for balance exercises or sports games.

As illustrated in FIGS. 3, 4, 6 and 7, the chair includes a base seating area having a frame 2, an outer cover 3 to cover the frame 2, a web 4 of elastic material concentrically arranged and attached to the outer cover 3, and a seat bottom 5 concentrically arranged and attached to the web 4 to permit the seat bottom 5 to move with a weight of a user occupying the chair; and a suspension system 1, 6 connected to the base seating area to permit the base seating area to be placed in a suspended position from at least one support point. The base seating area, when in the suspended position and occupied by the user, is moveable in a vertical plane and a lateral plane with respect to the at least one support point. Meaning the chair may move upward and downward and also pivot about the at least one support point.

The suspension system is attached at a plurality of attachment points to the outer cover 3 to provide for enhanced stability. The suspension system may comprise a plurality of ropes 1 composed of nylon. Each rope 1 may be threaded through holes in the cover 3 and fixed via a knot at a first end the attachment point in order to prevent the rope 1 from sliding completely through the hole in the cover 3. The second end of adjacent ropes 1 may then be tied together and attached to a ring 6 to be received by a hook at an indoor or an outdoor suspension point.

Figure 2:
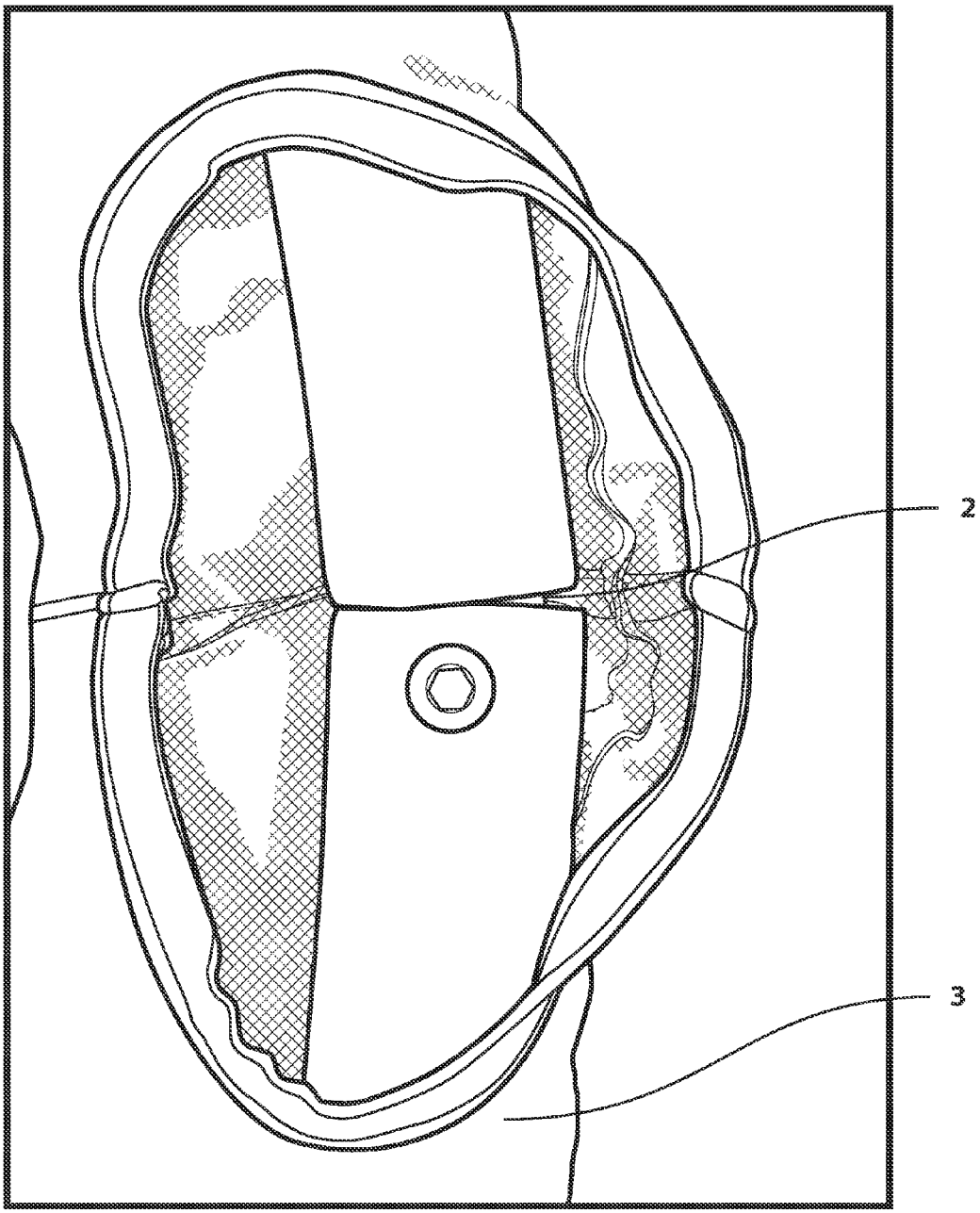
FIG. 2 illustrates a sectional view of a frame of a swinging chair in a connected state, in accordance with embodiments.
Figure 3:
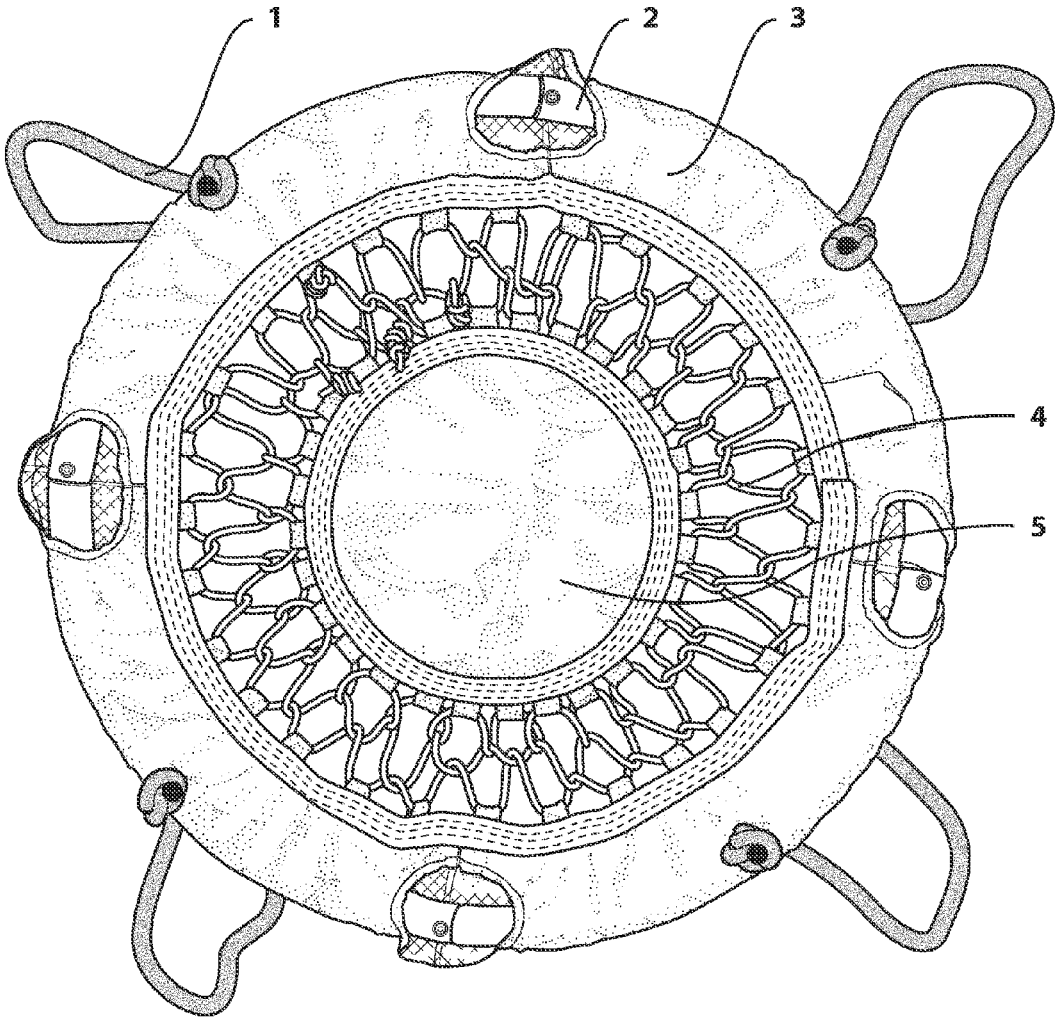
FIG. 3 illustrates a bottom view of a base seating portion of a swinging chair, in accordance with embodiments.
Figure 4:
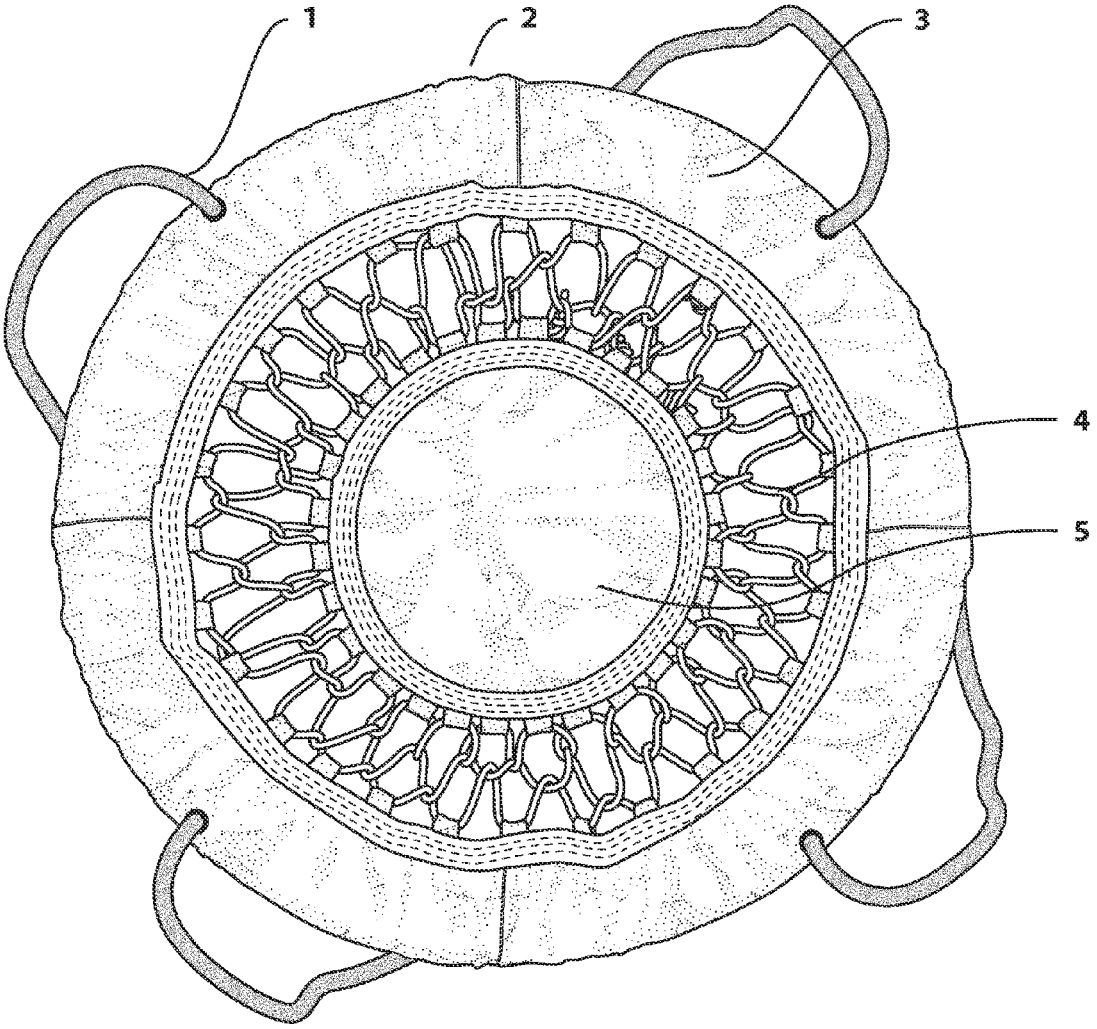
FIG. 4 illustrates a top view of a base seating portion of a swinging chair, in accordance with embodiments.

As illustrated in FIGS. 1 and 2, the frame 2 includes a plurality of rings that are interlocked to each other mechanically using, for example, screws, bolts, and the like. The rings of the frame 2 may have diameter of approximately two to three inches and be composed of a robust material such as steel which has an outer layer of a foam material. Embodiments, however, are not limited to such a configuration and may encompass other configurations that will fall within the spirit and scope of the principles of this disclosure. The frame 2 and the mechanical attachments are covered by a cover 3 that may be composed of a material such as, for example, nylon.

Figure 5:
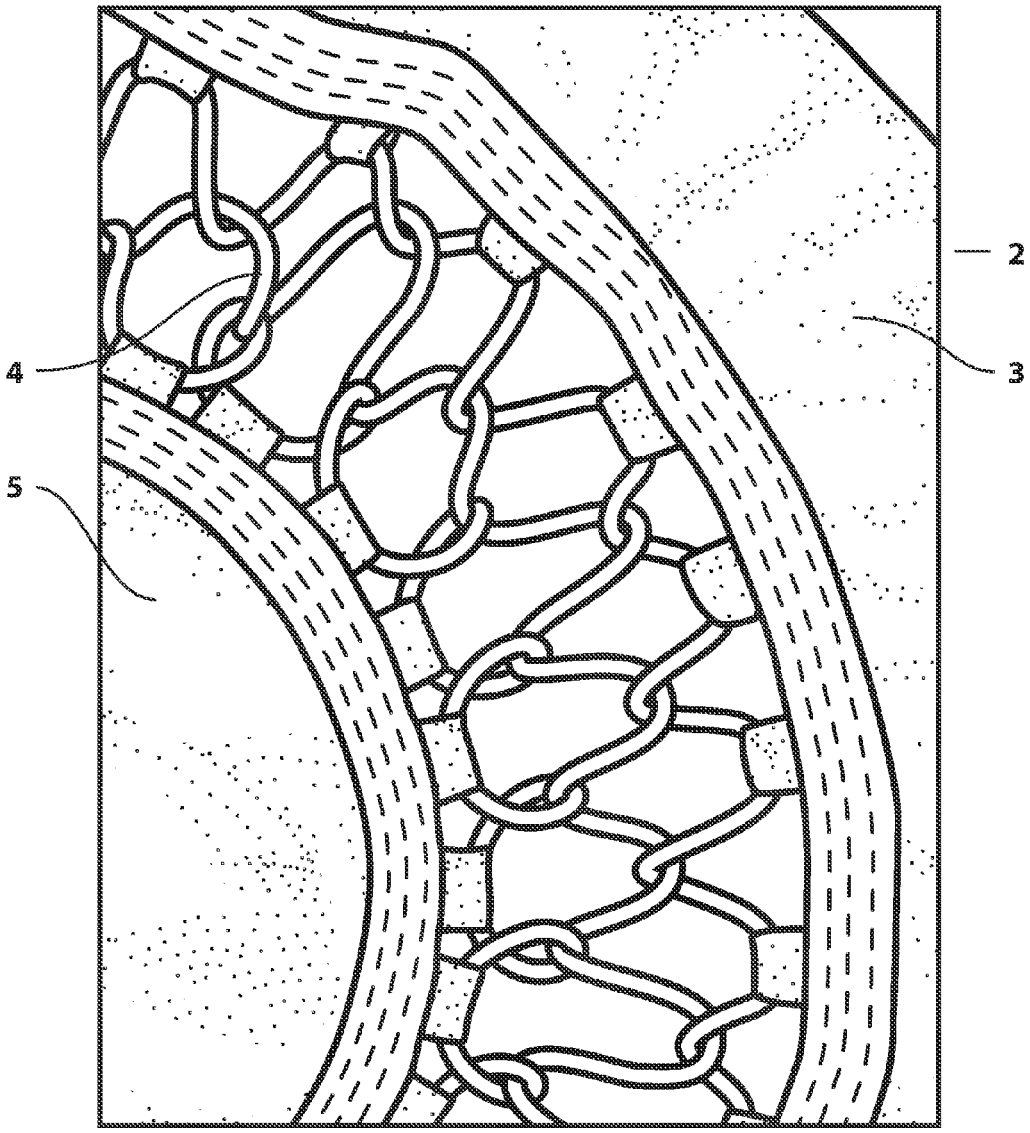
FIG. 5 illustrates a sectional view of a base seating portion of a swinging chair, in accordance with embodiments.
Figure 6:
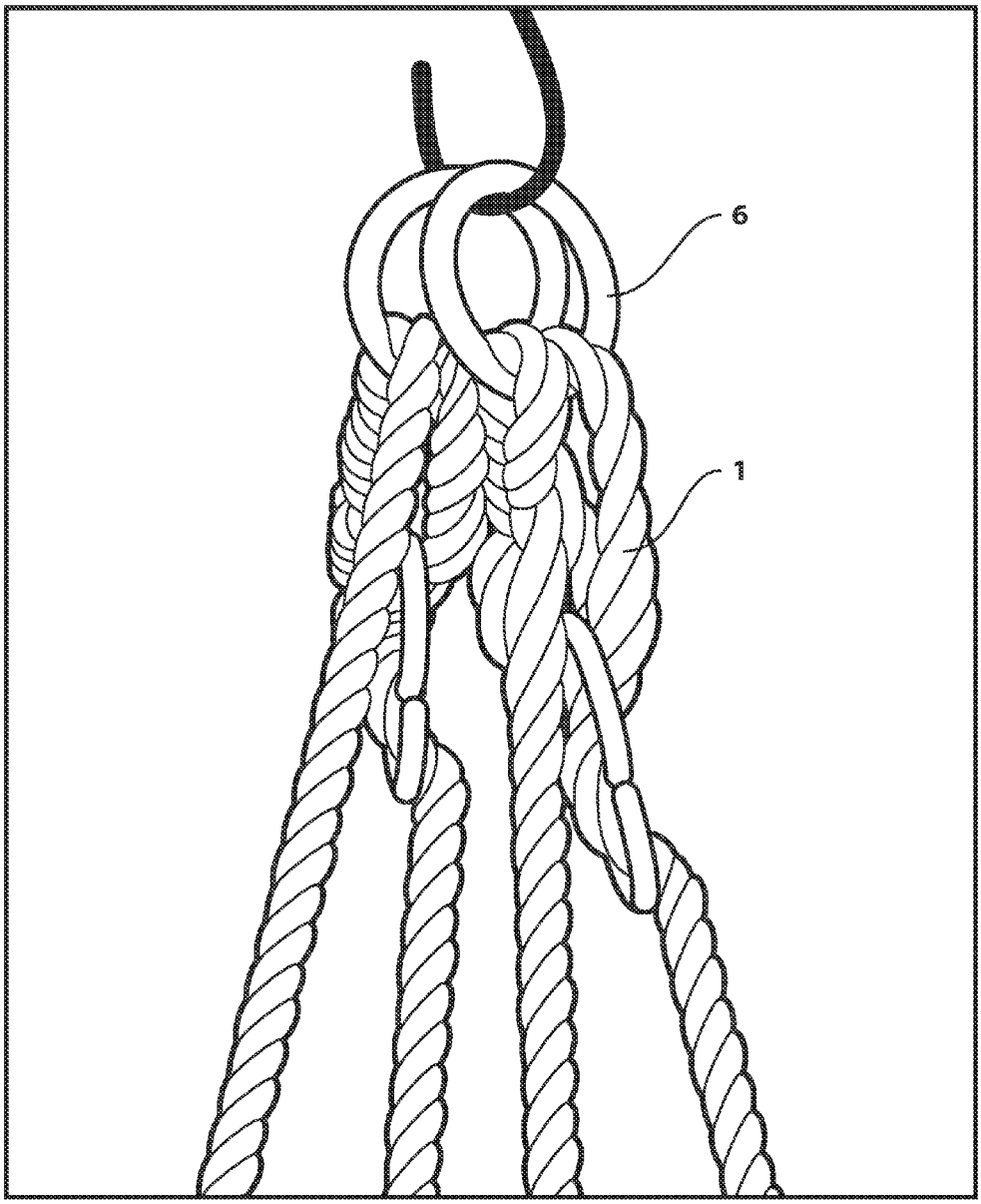
FIG. 6 illustrates a suspension system of a swinging chair, in accordance with embodiments.
Figure 7:
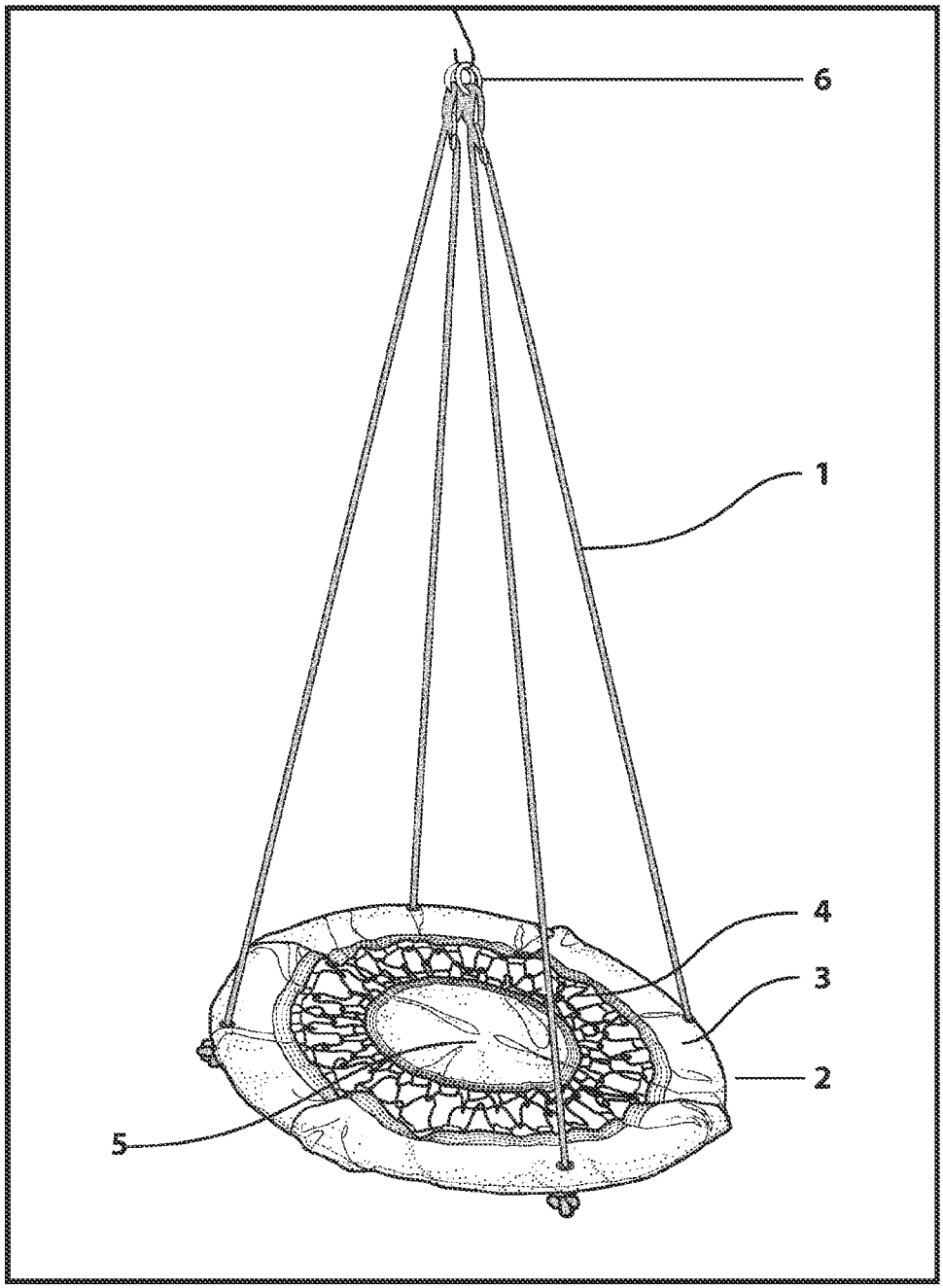
FIG. 7 illustrates a perspective view of a swinging chair, in accordance with embodiments.

As illustrated in FIG. 5, the web 4 of elastic material is concentrically arranged and comprises a plurality of interlocking bungee cords that are attached to a plurality of spaced apart grommets (which may be composed of a robust material such as, for example, steel) of the outer cover 3 and the seat bottom 5. The grommets of the cover 3 may have a size of approximately 0.8 inches and may be spaced apart a predetermined distance of 3.5-4 inches. Embodiments, however, are not limited to such a configuration and may encompass other configurations that will fall within the spirit and scope of the principles of this disclosure. The corresponding grommets of the seat bottom 5 may have the same size but may be spaced apart at a predetermined distance that is less than that of the grommets of the cover 3. A first, outer bungee cord of the web 4 may be threaded through the grommets of the cover 3 while a second, inner bungee cord of the web 4 may be threaded through the grommets of the seat bottom 5. A third, intermediate bungee cord interlocks the first and second bungee chords to create the web 4. The bungee cords of the web 4 permit the chair to move with the weight of the user sitting in the chair. By virtue of the fact the bungee cords have the ability to stretch, the chair provides a more stable and comfortable sitting area and can more safely swing or pivot.

In accordance with embodiments, the seat bottom 5 of nylon material may be optional, in which case the web the web 4 may be configured in such a way as to form a seating area for a user.

Figure 8:
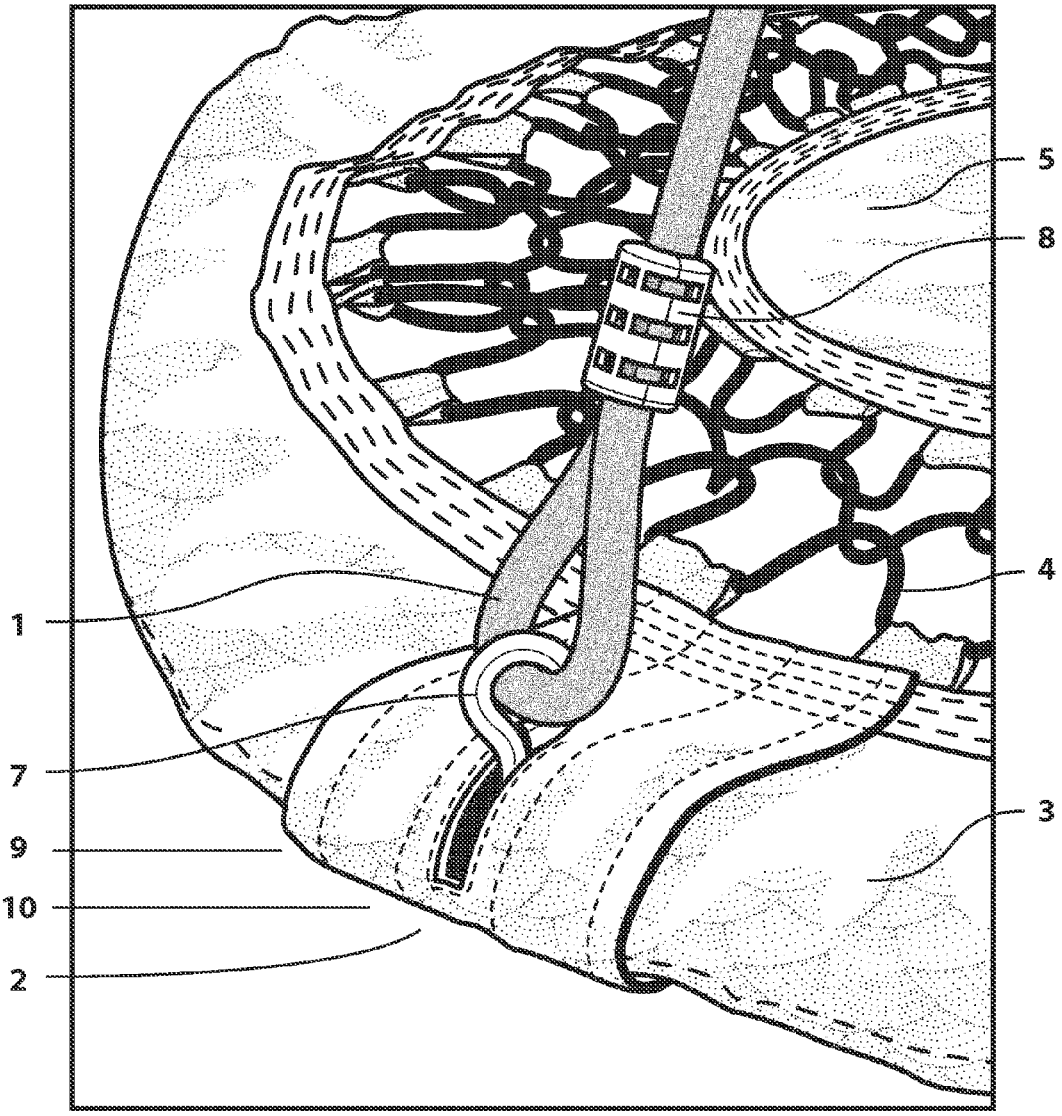
FIG. 8 illustrates a sectional view of an attachment between the suspension system and the base seating area of a swinging chair, in accordance with embodiments.
Figure 9:
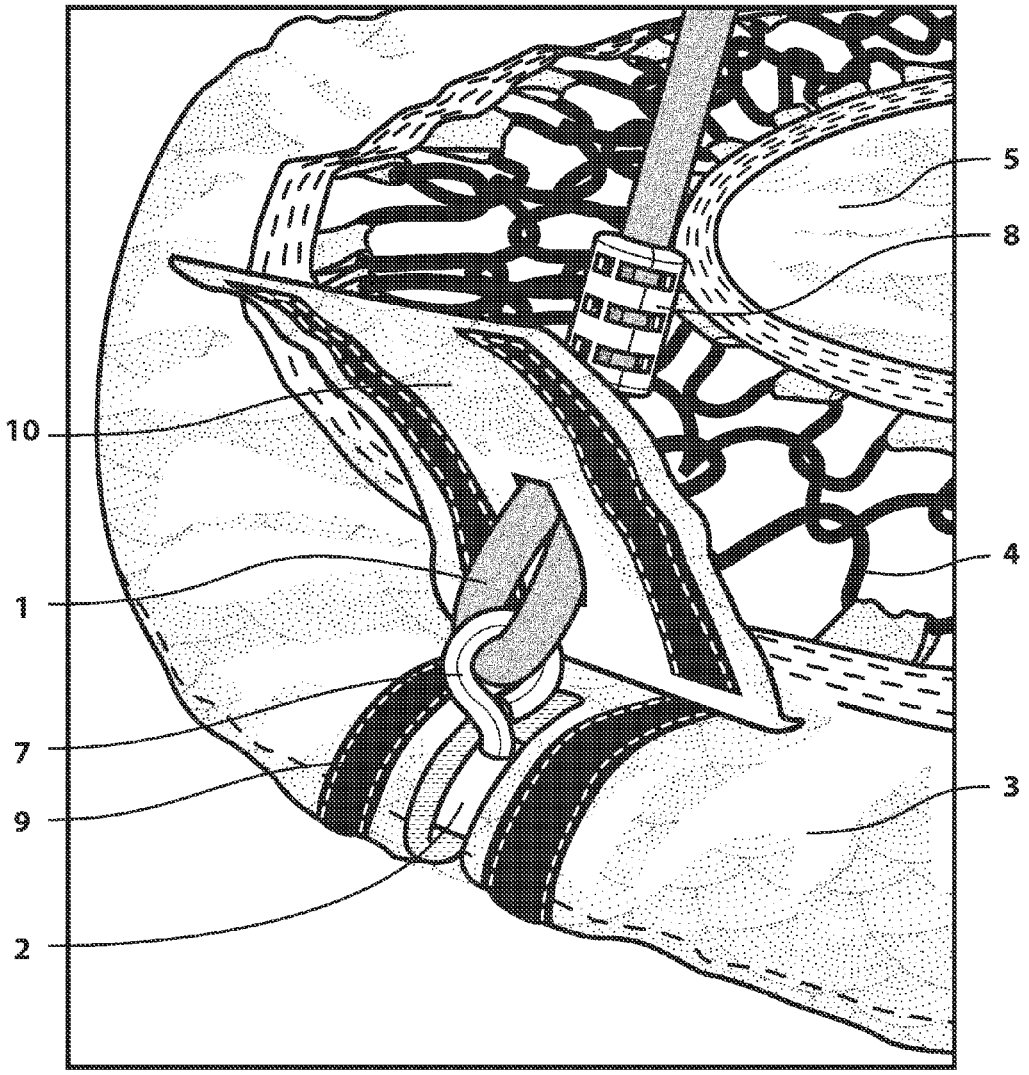
FIG. 9 illustrates a sectional view of an attachment between the suspension system and the base seating area of a swinging chair, in accordance with embodiments.
Figure 10:
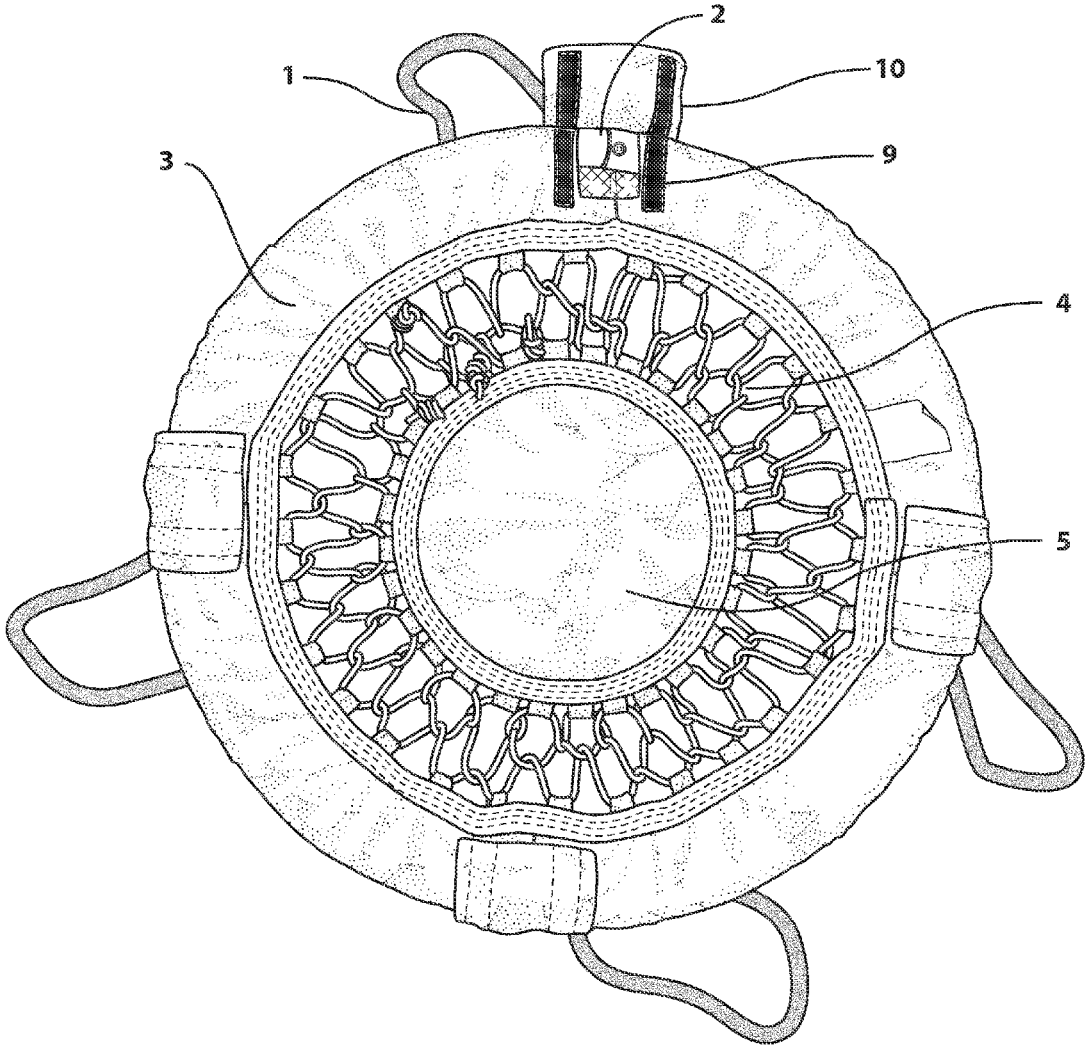
FIG. 10 illustrates a bottom view of a base seating portion of the swinging chair of FIG. 8, in accordance with embodiments.

As illustrated in FIGS. 8-10, in accordance with embodiments, the suspension system may be directly attached at a plurality of attachment points to the frame 2 to provide for even enhanced stability of the chair. One end of each rope 1 of the suspension system forms a loop that is received into a corresponding hole of a ring 7 that extends from the frame 2 and through a hole in the cover 3. The ring may be composed of a robust material such as, for example, steel. Spatially above the loop of the rope 1 is locking clasp 8 that clasps the rope 1. The second end of adjacent ropes 1 may then be tied together and attached to a ring 6 to be received by a hook at an indoor or an outdoor suspension point. The opening produced by the ring 7 is to be covered with a security flap 10 of the cover 3 that itself has a hole through which the clasped rope 1 and ring 7 extends through. The security flap 10 is moveable or otherwise pivotably connected to the outer surface of the cover 3 and moveable between a first, open position in which the clasped rope 1 and ring 7 are uncovered, and a second, closed position which covers the clasped rope 1 and ring 7. The security flap 10 may be removeably fastened mechanically to the outer surface of the cover 3. Such mechanical fastening may be produced via, for example, one or a plurality of Velcro™ strips 9 provided on the inner surface of the security flap 10 that are connectable to corresponding Velcro™ strips 9 on the outer surface of the cover 3.

Additional Notes and Examples:

Example One may include a chair comprising a base seating area having a frame, an outer cover to cover the frame, a web of elastic material concentrically arranged and attached to the outer cover, and a seat bottom concentrically arranged and attached to the web to permit the seat bottom to move with a weight of a user occupying the chair; and a suspension system connected to the base seating area to permit the base seating area to be placed in a suspended position from at least one support point, wherein the base seating area, when in the suspended position and occupied by a user, is moveable in a vertical plane and a lateral plane with respect to the at least one support point.

Example Two may include the chair of Example One, wherein the web of elastic material comprises at least one bungee cord.

Example Three may include the chair of Example One, wherein the frame comprises one or more steel rings.

Example Four may include the chair of Example Three, wherein each steel ring interlocks to an adjacent steel ring.

Example Five may include the chair of Example One, wherein the outer cover and the seat bottom are composed of the same material.

Example Six may include the chair of Example One, wherein the outer cover and the seat bottom are composed of nylon.

Example Seven may include the chair of Example One, wherein the suspension system comprises a plurality of nylon ropes attached to one of the outer cover and the frame.

Example Eight may include a swinging chair comprising an outer frame; a frame cover to cover the outer frame; a web of elastic material attached to the cover; a seat bottom that is connected to the web to permit the seat bottom to move with a weight of a user occupying the chair; and a suspension system that is connected to the frame to permit the seat bottom to be placed in a suspended position from at least one support point, wherein the seat bottom, when in the suspended position and occupied by a user, is moveable in a vertical plane and a lateral plane with respect to the at least one support point.

Example Nine may include the swinging chair of Example Eight, wherein the web of elastic material comprises at least one bungee cord.

Example Ten may include the swinging chair of Example Eight, wherein the frame comprises a plurality of interlocking rings.

Example Eleven may include swinging chair of Example Ten, wherein the suspension system comprises a plurality of ropes attached to the frame, and an attachment ring that extends from the frame and through a hole in the frame cover; and a first end of each rope is looped through a hole of the ring to be clasped via the locking clasp, with a second end of the rope being attached to an adjacent rope at the least one support point.

Example Twelve may include the swinging chair of Example Eleven, further comprising a security flap pivotally moveable about the outer surface of the cover between a first, open position in which the clasped rope and ring are uncovered, and a second, closed position which covers the clasped rope and ring.

Example Thirteen may include swinging chair of Example Eight, wherein the security flap is removeably fastened mechanically to the outer surface of the cover.

Example Fourteen may include the swinging chair of Example Eight, wherein the security flap includes a plurality of Velcro™ strips provided on the inner surface thereof that are removeably fastened to corresponding Velcro™ strips on the outer surface of the cover.

Example Fifteen may include a chair comprising, a frame; a frame cover to cover the frame; a seat bottom concentrically arranged and attached to the frame cover; and a web of elastic material concentrically arranged and attached at a first end to the frame cover and a second end to the seat bottom to permit the seat bottom to move with a weight of a user occupying the chair, wherein the seat bottom, when in a suspended position at a support point and occupied by a user, is moveable in a vertical plane and a lateral plane with respect to the support point.

Example Sixteen may include the chair of Example Fifteen, further comprising a suspension system having a plurality of ropes connected to the frame to permit the seat bottom to be placed in the suspended position from the support point.

Example Seventeen may include the chair of Example Sixteen, wherein the suspension system comprises an attachment ring that extends from the frame and through a hole in the frame cover; and a first end of each rope is looped through a hole of the ring to be clasped via the locking clasp, with a second end of the rope being attached to an adjacent rope at the least one support point.

Example Eighteen may include the chair of Example Seventeen, further comprising a security flap pivotally moveable about the outer surface of the cover between a first, open position in which the clasped rope and ring are uncovered, and a second, closed position which covers the clasped rope and ring.

Example Nineteen may include the chair of Example Eighteen, wherein the security flap is removeably fastened mechanically to the outer surface of the frame cover.

Example Twenty may include the chair of Example Eighteen, wherein the security flap includes a plurality of Velcro™ strips provided on the inner surface thereof that are removeably fastened to corresponding Velcro™ strips on the outer surface of the frame cover.

The term "coupled" or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

LIST OF REFERENCE SIGNS

1 Rope (suspension system)
2 Frame
3 Cover
4 Web of elastic material
5 Center support
6 Rings (suspension system)
7 Ring
8 Clasp
9 Connector
10 Security Flap

What is claimed is:

1. A chair, comprising:
a frame;
a frame cover to cover the frame;
a seat bottom concentrically arranged and attached to the frame cover;
a web of elastic material concentrically arranged and attached at a first end to the frame cover and a second end to the seat bottom to permit the seat bottom to move when occupied;
a suspension system having a plurality of ropes connected to the frame to permit the seat bottom to be placed in a suspended position from a support point, an attachment ring that extends from the frame and through a hole in the frame cover, wherein a first end of each rope is looped through a hole of the ring to be clasped via a locking clasp, with a second end of the rope being attached to an adjacent rope at the support point; and
a security flap pivotally moveable about the outer surface of the cover between a first, open position in which the clasped rope and ring are uncovered, and a second, closed position which covers the clasped rope and ring,
wherein the seat bottom, when in the suspended position at the support point and occupied, is moveable in a vertical plane and a lateral plane with respect to the support point.

2. The chair of claim 1, wherein the web of elastic material comprises at least one bungee cord.

3. The chair of claim 1, wherein the security flap is removeably fastened mechanically to the outer surface of the frame cover.

4. The chair of claim 1, wherein the security flap includes a plurality of hook and loop fasteners provided on the inner surface thereof that are removeably fastened to corresponding hook and loop fasteners on the outer surface of the frame cover.

5. The chair of claim 1, wherein the frame comprises a plurality of steel rings.

6. The chair of claim 5, wherein each steel ring interlocks to an adjacent steel ring.

7. A chair, comprising:
a frame;
a frame cover to cover the frame;
a seat bottom concentrically arranged and attached to the frame cover;
a web of elastic material concentrically arranged and attached at a first end to the frame cover and a second end to the seat bottom to permit the seat bottom to move when occupied; and
a suspension system having a plurality of ropes connected to the frame to permit the seat bottom to be placed in a suspended position from a support point, an attachment ring that extends from the frame and through a hole in the frame cover, wherein a first end of each rope is looped through a hole of the ring to be clasped via a locking clasp, with a second end of the rope being attached to an adjacent rope at the support point,
wherein the seat bottom, when in the suspended position at the support point and occupied, is moveable in a vertical plane and a lateral plane with respect to the support point.

8. A swinging chair, comprising:
an outer frame;
a frame cover to cover the outer frame;
a web of elastic material concentrically arranged and attached to the cover;
a seat bottom concentrically arranged and attached to the web to permit the seat bottom to move when occupied; and
a suspension system that is connected to the frame to permit the seat bottom to be placed in a suspended position from at least one support point the suspension system having a plurality of ropes attached to the frame, and an attachment ring that extends from the frame and through a hole in the frame cover, wherein a first end of each rope is looped through a hole of the ring to be clasped via a locking clasp, with a second end of the rope being attached to an adjacent rope at the at least one support point,
wherein the seat bottom, when in the suspended position and occupied, is moveable in a vertical plane and a lateral plane with respect to the at least one support point.

9. The swinging chair of claim 8, wherein the web of elastic material comprises at least one bungee cord.

10. The swinging chair of claim 8, wherein the frame comprises a plurality of interlocking rings.

11. The swinging chair of claim 8, further comprising a security flap pivotally moveable about the outer surface of the cover between a first, open position in which the clasped rope and ring are uncovered, and a second, closed position which covers the clasped rope and ring.

12. The swinging chair of claim 11, wherein the security flap is removeably fastened mechanically to the outer surface of the cover.

13. The swinging chair of claim 11, wherein the security flap includes a plurality of hook and loop fasteners provided on the inner surface thereof that are removeably fastened to corresponding hook and loop fasteners on the outer surface of the cover.

* * * * *